US007347229B2

(12) United States Patent
Glenn et al.

(10) Patent No.: US 7,347,229 B2
(45) **Date of Patent: *Mar. 25, 2008**

(54) TUBULAR FABRIC AND METHOD OF MAKING THE SAME

(75) Inventors: Robert Arthur Glenn, Loughborough (GB); Henry Arthur Sebastian Price, Loughborough (GB)

(73) Assignee: Stretchline Intellectual Properties Limited, Tortola (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/484,334

(22) PCT Filed: Jul. 15, 2002

(86) PCT No.: PCT/GB02/03236

§ 371 (c)(1),
(2), (4) Date: Jun. 28, 2004

(87) PCT Pub. No.: WO03/008683

PCT Pub. Date: Jan. 30, 2003

(65) Prior Publication Data

US 2004/0231744 A1 Nov. 25, 2004

(30) Foreign Application Priority Data

Jul. 17, 2001 (GB) ..... 0117351.7
Jan. 11, 2002 (GB) ..... 0200692.2

(51) Int. Cl.
*D03D 3/02* (2006.01)
*D03D 17/00* (2006.01)
*D03D 15/08* (2006.01)
*D03D 25/00* (2006.01)

(52) U.S. Cl. ..... 139/387 R; 139/426 R; 450/41; 450/43

(58) Field of Classification Search ..... 139/387 R, 139/426 R; 450/41, 43; 428/36.3, 36.1; 156/181, 307.3; 442/182–184, 306, 105, 442/168, 169
See application file for complete search history.

(56) References Cited

U.S. PATENT DOCUMENTS 3,255,030 A 6/1966 Storti ..... 442/105

(Continued)

FOREIGN PATENT DOCUMENTS

DE 1 922 803 5/1968

(Continued)

OTHER PUBLICATIONS

International Search Report No. PCT/GB02/03236 dated Feb. 5, 2003 for International Application No. GB 0200692.2.

(Continued)

*Primary Examiner*—Gary L. Welch
*Assistant Examiner*—Robert H Muromoto, Jr.
(74) *Attorney, Agent, or Firm*—Morgan, Lewis & Bockius LLP

(57) ABSTRACT

A tubular fabric receives an underwire in a garment such as a bra. The tubular fabric is formed by arranging a fusible yarn, such as Grilon®, and melting said yarn to form a barrier, which exhibits excellent resistance to penetration by underwires. Preferably the fabric does not include an elastomeric yarn or contains a minor amount and is treated to impart stretch to the fabric in the length direction.

70 Claims, 6 Drawing Sheets

U.S. PATENT DOCUMENTS

| | | | | |
|---|---|---|---|---|
| 3,434,478 | A * | 3/1969 | Cohen et al. | 450/39 |
| 3,594,262 | A | 7/1971 | Magidson | 442/183 |
| 3,616,149 | A * | 10/1971 | Wincklhofer et al. | 428/196 |
| 3,620,892 | A | 11/1971 | Wincklhofer et al. | |
| 5,395,665 | A | 3/1995 | Planeta | 428/36.3 |
| 5,749,400 | A | 5/1998 | Pascual | 442/182 |
| 5,889,229 | A | 3/1999 | Sosnowski | |
| 6,000,442 | A * | 12/1999 | Busgen | 139/389 |
| 6,071,578 | A * | 6/2000 | Richardson et al. | 428/36.3 |
| 6,805,610 | B2 * | 10/2004 | Luk | 450/54 |
| 6,824,445 | B2 * | 11/2004 | Oneyear et al. | 450/70 |
| 6,837,771 | B2 * | 1/2005 | Falla | 450/39 |
| 6,846,217 | B1 * | 1/2005 | Struble et al. | 450/31 |
| 6,863,589 | B2 * | 3/2005 | Cano | 450/65 |
| 6,896,580 | B2 * | 5/2005 | Falla et al. | 450/41 |
| 7,032,626 | B2 * | 4/2006 | Glenn et al. | 139/426 R |

FOREIGN PATENT DOCUMENTS

| | | |
|---|---|---|
| EP | 0 802 269 A1 | 10/1997 |
| EP | 1 060 678 A2 | 12/2000 |
| FR | 2 723 295 A | 2/1996 |
| GB | 1 512 906 | 6/1978 |
| GB | 2 247 696 | 3/1992 |
| GB | 2 247 696 A | 3/1992 |
| GB | 2 309 038 | 7/1997 |
| GB | 2 309 038 A | 7/1997 |
| GB | 2 356 643 | 5/2001 |
| GB | 2 366 574 | 3/2002 |
| WO | WO 94/28227 | 12/1994 |
| WO | WO 01 11131 A | 2/2001 |
| WO | WO 01/11132 A1 | 2/2001 |

OTHER PUBLICATIONS

International Publication No. WO 03/008683 A2 dated Jan. 30, 2003, for International Application No. PCT/GB02/03236.

* cited by examiner

| | | | | | | | | | | | | | | | |
|---|---|---|---|---|---|---|---|---|---|---|---|---|---|---|---|
| | X | | C | C | X | C | X | X | X | C | X | C | | C | |
| | X | C | | C | C | X | X | C | X | X | X | X | | | |
| X | | | C | C | X | C | X | C | X | X | X | X | | | |
| X | | C | C | | C | X | X | C | X | X | X | X | | | |
| | X | | C | C | X | C | X | X | C | X | C | X | C | | |
| | X | C | | C | C | X | X | X | C | X | X | X | | | |
| X | | | C | C | X | C | X | X | C | X | X | X | | | |
| X | | C | C | | C | X | C | X | X | X | X | X | | | |
| | X | | C | C | X | C | C | X | X | X | X | C | | C | |
| | X | C | | C | C | X | C | X | X | X | X | X | | | |
| X | | | C | C | X | C | X | X | X | C | X | X | | | |
| X | | C | C | | C | X | X | X | X | C | X | X | | | |
| | X | | C | C | X | C | X | X | X | C | C | X | C | | |
| | X | C | | C | C | X | X | C | X | X | X | X | | | |
| X | | | C | C | X | C | X | C | X | X | X | X | | | |
| X | | C | C | | C | X | X | C | X | X | X | X | | | |
| | X | | C | C | X | C | X | X | C | X | X | C | | C | |
| | X | C | | C | C | X | X | X | C | X | X | X | | | |
| X | | | C | C | X | C | X | X | C | X | X | X | | | |
| X | | C | C | | C | X | C | X | X | X | X | X | | | |
| | X | | C | C | X | C | C | X | X | X | C | X | C | | |
| | X | C | | C | C | X | C | X | X | X | X | X | | | |
| X | | | C | C | X | C | X | X | X | C | X | X | | | |
| X | | C | C | | C | X | X | X | X | C | X | X | | | |

1 2 3 4 5 6 7 8 9 10 11 12 13 14 15

*Fig. 6*

TUBULAR FABRIC AND METHOD OF MAKING THE SAME

The present invention relates to a tubular fabric, a method of making the same and to articles manufactured therefrom, particularly underwired garments such as brassieres.

It is known to produce fabric tubing for receiving a curved underwire. Conventionally such fabric tubing is made by forming three separate fabric strips. The strips are folded and sewn together to form a tube into which an underwire can be received.

A considerable problem with known fabric tubing for underwires is that the ends of the underwires can penetrate the tubing, either during the course of garment manufacture or in use by a wearer.

At present, a significant proportion of brassiere (bra) manufacturers products are returned because of protrusion of the underwire through the fabric tubing.

Underwire protrusion through the tubing is perhaps most commonly the result of washing the garment such as a bra in a washing machine. Whilst such washing is not presently recommended by garment manufacturers, it is commonplace. Clearly, product failure as a result of underwire protrusion is costly and can have a deleterious effect on customer satisfaction.

These problems were addressed in GB 2,309,038, which provided a tubular fabric for receiving an underwire, the fabric comprising a support yarn, an elastomeric yarn and a fusible yarn which was arranged within the fabric tube so that it was capable of forming a penetration barrier.

It was known that the elastomeric yarn was required to lend the fabric a desirable degree of flexibility or "give" which is important, as the fabric must be curved to receive an underwire. GB 2,309,035 noted that if the fabric did not include the elastomeric yarn it would not lie flat and be puckered when the underwire was in position, making the finished product unappealing aesthetically and uncomfortable to wear. GB 2,309,038 noted that a skilled person would appreciate that a range of elastomeric yarns could be employed, and that an elastane e.g. Lycra™ is preferred both for its well proven performance and widespread commercial acceptance. A particularly preferred Lycra™ yarn in GB 2,309,038 is distributed by Wykes of Leicester, England under their product code 2581 and comprises a core of 235 decitex (dtex) Lycra™ (Du Pont) covered on top by 1 fold 78 dtex textured 18 filament Nylon 6 (Du Pont) and on the bottom by 1 fold 78 dtex textured 18 filament Nylon 6 (Du Pont).

In light of GB 2,309,038, it has been surprisingly shown that a fabric tube capable of preventing underwire protrusion can be formed without using an elastomeric yarn.

According to the first aspect the present invention provides a tubular fabric which is particularly useful for receiving an underwire, the fabric comprising a support yarn and a fusible yarn wherein the yarns are formed into a tubular fabric and the fusible yarn is arranged within the fabric tube so that, when fused, it forms a barrier to penetration by a bra wire; characterised in that the fabric does not include an elastomeric yarn.

By "fusible yarn" we include the meaning that the yarn can be melted at a predetermined temperature and cooled to adhere to the support yarn. Advantageously, the fusible yarn melts at less than 100° C., especially 90° C. or less, and can be cooled to produce a material having a higher melting point than the predetermined temperature, and preferably more than 100° C.

The most preferred fusible yarn for use in the invention is a polyamide yarn, especially that sold by EMS-CHEMIE AG of CH-7013 Domat/EMS, Switzerland under the name Grilon™.

Advantageously, the fusible yarn is in the form of a multifilament, preferably comprising 14 filaments.

Whilst fusible yarn in the form of monofilaments, such as those produced by Luxilon Industries in Belgium (under the trade name "Luxilon"), or Toray Industries in Japan, could be used in the present invention, a multifilament yarn is preferred because on melting it spreads more easily over the fabric. In contrast, the melting of a monofilament produces a less even spread which may be less comfortable to a Wearer of a finished garment incorporating the tubular fabric of the invention.

Preferably, the fusible yarn is treated by heating whereby it melts and spreads over the interior surface of the tubular fabric. On cooling, the fusible yarn adheres to the other yarns of the fabric to produce a tubular fabric having a durable inner lining of the melted fusible yarn.

Preferably, when the fusible yarn is a polyamide the treatment to melt the fusible yarn comprises a conventional polyamide fabric dyeing process.

The temperature involved in the dyeing process exceeds the melting point of the fusible polyamide yarn. Conveniently, the fusible polyamide yarn is Grilon™ having a melting point of 85° C. Typical polyamide dyeing processes reach temperatures of around 100° C.

A particular preferred feature of Grilon™ is that on cooling it retains a melting point "memory" for the temperature reached during the dyeing process i.e. after the dyeing process its melting point changes from 85° C. to 100° C. or more. It will be appreciated that this feature confers the important advantage that the tubular fabric product will not deteriorate on washing by a user in a washing machine because the "new" melting point of the melted fusible yarn will not be reached during normal washing.

A skilled person will understand that a fusible yarn of the invention is intended to include any yarn which can melt at a predetermined temperature, preferably 70-90° C., more preferably 75-90° C., and adhere to other yarns of the fabric to form a penetration barrier. On cooling, the melted fusible yarn preferably produces a coating, which has a melting temperature in excess of the predetermined temperature and preferably in excess of 100° C.

Preferably, the support yarn is a polyamide, especially a textured polyamide. The support yarn is preferably composed of multifilaments. Preferred support yarns include Nylon 6 or Nylon 66 sold by Du Pont, which comprises a 24 filament, textured polyamide yarn.

It is preferred that the fusible yarn and the support yarn are composed of the same material, advantageously a polyamide, so that they can be adhered to one another easily and so that their respective dyeing properties will be the same. A uniformity of dyeing throughout the fabric of the invention is an important commercial and aesthetic consideration.

Fabrics of the first aspect of the invention do not include an elastomeric yarn. Typically, the amount of elastomeric yarn in the fabric of the invention will be less than 0.5%, preferably less than 0.25%, more preferably less than 0.1%, even more preferably less than 0.05%, yet more preferably less than 0.01%, most preferably 0% by weight. Put another way, in the most preferred aspect the fabric of the invention does not have any elastomeric yarn. The term "elastomeric yarn" has a meaning well known in the art and is typically an elastane, e.g. Lycra™, such as product code 2581 distributed by Wykes of Leicester, a particularly preferred Lycra™ of the prior art patent GB 2,309,038.

The term "underwire" is intended to include any substantially rigid structural member and it need not be made from a metal. For example, a structural member formed from a substantially rigid plastic or from bone may be preferred in certain garments incorporating the tubular fabric of the invention. Such structural members are intended to fall within the scope of the term "underwire" as used herein.

In a second aspect the invention provides a method for making a tubular fabric which is particularly useful for receiving an underwire, comprising providing a support yarn and a fusible yarn wherein the yarns are formed into a tubular fabric and the fusible yarn is arranged within the fabric tube so that, when fused, it forms a barrier to penetration by a bra wire; and characterised in that the fabric does not include an elastomeric yarn.

Preferably, the yarns are formed into a tubular fabric by a weaving process. Whilst the tubular fabric can also be formed by a knitting process, a weaving process is preferred because, in general, weaving produces a denser fabric than an equivalent knitting process. Also, a knitted fabric is typically less comfortable than a woven fabric due to its more open structure.

The fabric tubing is preferably formed by weaving two fabric tapes. The tapes are overlaid and their edges joined by edge threads, rising from the bottom tape to the top tape and vice versa.

Each tape preferably has two weft threads (one being a fusible yarn and the other a support yarn) inserted by one needle and knitted by a catch thread onto a latch needle.

It is possible to make a similar tubular fabric using a single weft needle. However, the production rate would be reduced significantly in comparison to the rate possible with a double weft needle. This is because the single needle would require approximately twice the number of picks to produce a fabric having the same strength as that produced by a double needle.

The weaving operation can be performed using a conventional narrow fabric loom. A preferred loom is produced by Jakob Müller AG, of Frick CH-5070 Frick, Switzerland and is known as Model Müller NF 6/27, and is fitted with a Müller NF system 3 catch thread attachment.

Preferably, threads are woven more loosely on one side (bottom) and the edges of the other side (top) to produce "soft" surfaces for increased comfort to a subsequent wearer.

Preferably the yarns are textured for improved comfort and low shrinkage properties. Advantageously, the yarns are composed of multifilaments.

A particularly preferred polyamide yarn is 2 fold 78 dtex textured Nylon 6 or Nylon 66 comprising 20/23 air mingled filaments. These yarns are available from Du Pont.

Preferably, the fusible yarn is 1 fold 75 dtex 14 filament Grilon™ K-85, available from EMS, Switzerland.

Preferably the fabric further comprises a catch thread which serapes to make a smaller softer knitted edge. Conveniently, the catch thread comprises 1 fold 44 dtex air mingled 13 filament or a 78 dtex 23 filament 1 fold textured Nylon 6 or Nylon 66 (Du Pont).

A skilled person will appreciate that the term decitex (dtex) refers to the thickness of the yarn. Yarns having a lower dtex than the preferred dtex mentioned above would produce a thinner fabric, which may be less comfortable to wear. Yarns with a higher dtex would produce a thicker fabric, which may be less flexible.

In the finished fabric weight the percentages of the different yarns are preferably in the ranges:

(i) fusible yarn 5-12%, especially approximately 8%;

(ii) catch thread less than 1%; and (iii) support yarn-balance to give 100%

If monofilament yarn is used for the fusible yarn, more yarn may be required to achieve satisfactory spreading, and the preferred range is from 5-20%, especially approximately 10%.

Preferably, the yarns are preshrunk using conventional heat treatments/washing. This improves the dimensional stability of the final fabric product.

Preferably, the methods of the invention comprise a further step of treating the tubular fabric by heating to melt the fusible yarn so that it spreads over the tubular fabric and is capable of forming a barrier to penetration by a bra wire. On cooling, the melted yarn adheres to the other yarns of the fabric to form a durable inner tube lining.

Advantageously, when the fusible and support yarns are polyamide, the treatment comprises a conventional polyamide fabric dyeing process, which involves temperatures in excess of the melting point of the fusible yarn.

The preferred fusible polyamide yarn is 1 fold 75 dtex 14 filament Grilon™ yarn, which has a predetermined melting point of approximately 85° C.

Dyeing can be achieved using a continuous pad/steam process; or by a vat (exhaust dyeing) process. In both methods the process is preferably controlled so that the temperature does not fall below a predetermined temperature which is in excess of the melting point of the fusible yarn. The dyeing temperature is typically 100° C. or more.

After dyeing, the dyed fabric tubing is dried and cooled Conveniently, the fabric can be further treated with a normal dyed fabric finishing step such as acid treatment (using citric acid) to reduce the pH of the finished fabric to less than 4 and thereby protect the fabric from phenolic yellowing which can arise if the fabric is exposed to nitrogen oxide fumes.

The fabric tubing produced in accordance with the invention has a durable inner lining of fusible yarn, which is extremely resistant to penetration by underwires.

In a preferred embodiment a fabric of the present invention has substantially no stretch characteristics in the width direction. By "substantially no stretch characteristics in the width direction" is included the meaning that the fabric typically stretches by not more than 5%, usually by not more than 3%, more preferably by not more than 2%, even more preferably by not more than 1%, yet more preferably by not more than 0.5%, most preferably the fabric will have substantially no stretch at all in the width direction.

According to a third embodiment of the invention there is provided a method of making a tubular fabric comprising providing a support yarn and an elastomeric yarn and a fusible yarn, the yarns being arranged into a tubular fabric or a fabric that is formed into a tubular fabric, whereby the fusible yarn is arranged within the fabric so that, when fused, it forms a barrier to penetration of the tubular fabric by a bra wire; the method comprising treating the fabric so that the yarn strands substantially across the width of the fabric are forced closer together to impart stretch into the fabric in the length direction.

It will be appreciated that a significant advantage of the methods of the third aspect of the invention is that one can reduce the amount of elastomeric yarn in the fabric because the stretch properties of the fabric are conferred by the treatment means. Since elastomeric yarns are generally the most expensive component of the fabric, the methods of the invention can be used to achieve significant cost savings in comparison to corresponding fabric which has not been treated to impart stretch and which therefore relies on the incorporation of elastomeric yarn to confer stretch properties to the fabric.

The composition and production of fabric according to the third embodiment of the invention is preferably as described in GB 2,309,038 B to Price Shepshed Ltd.

Stretch characteristics may be imparted in any of the fabrics of the invention by treating the fabric in such a manner that the yarn strands substantially across the width of the fabric are forced closer together thus imparting stretch into the fabric in the length direction. A preferred treatment for imparting stretch involves the application of heat and pressure to the fabric. This process is termed compressive shrinkage and is described in EP 0,705,356 and WO 01/11131. Compressive shrinkage can be achieved by use of a machine which comprises means for applying heat and pressure to a woven fabric, and transport means for effecting relative movement between the heat and pressure application means and the fabric whereby passage of the fabric through the apparatus results in the yarn strands substantially across the width of the fabric being forced closer together. Typically this imparts a semi-permanent stretch into the fabric.

Preferably the stretch is imparted in the length direction. More preferably, substantially no stretch is imparted in the width direction. Put another way, more preferably the stretch of the fabric in the width direction is substantially unchanged by the compressive shrinkage process.

One passage through the machine will usually be sufficient to impart stretch into the fabric in the length direction, although 2, 3, 4, 5 or more passes may be used.

At the temperature typically used in compressive shrinkage, thermoplastic yarns within the fabric are heat set so that the extra elasticity imparted to it by the compressive shrinking process is rendered "permanent". Such temperatures typically need to be hot enough to melt the fusible yarn (e.g. Grilon™) but not hot enough to melt nylon. Typically synthetic materials need relatively high temperatures, e.g. about 80-200°, typically about 85-200°, usually about 180° C., to cause compressive shrinkage. Thus, whilst the sleeve used in a compression machine may be constructed with any suitable substance, typically rubber, it is preferred to use a sleeve compound such as EPDM which is less likely to become degraded and hard at these temperatures.

EP 0,705,356 describes a method of imparting a stretch into a fabric which is made permanent by simultaneous bonding of the fabric to a synthetic interlining fabric, and is useful for producing a waistband interlining. WO 01/11131 describes a method of producing a two-way stretchable fabric by compressive shrinkage, which is useful for producing lining fabrics, particularly for lining garments which themselves have stretch characteristics, e.g. produced with Lycra™ or equivalent yarns, such as skirts, jacquard and other plain or printed ribboning, tape or labelling, and can utilise woven fabrics, synthetic non-woven or knitted fabrics.

The process of compressive shrinkage may take place after, before or simultaneously with the process of melting the fusible yarn and/or dyeing the fabric. By "simultaneously" is meant that the temperature of the fabric is not allowed to return to room temperature between melting, dyeing and compressive shrinkage processes. Typically compressive shrinkage is performed after melting and/or dyeing.

Preferred embodiments of the invention will now be described by way of non-limiting examples, with reference to the following drawings in which:

FIG. 6 shows the Heald frame lifting plan for weaving a closed fabric tubing of the invention, wherein X=UP on chain, .=DOWN on chain and C=CENTRE on chain;

The preferred fusible polyamide, Grilon™ K-85, has a melting point of approximately 85° C. and a preferred yarn count dtex of 75. According to the manufacturer's technical data sheet Grilon™ K-85 has the following properties:

| | |
|---|---|
| Melting range | 78-88° C. (172-190° F.) |
| Application temperature range | 95-120° C. (203-248° F.) |
| Melt viscosity DIN 53735, 160° C./21.6N | 900 Pa · s |
| Yarn count | 75 dtex 14 filaments |
| Tenacity | 28 cN/tex |
| Elongation at break | 40-70% |
| Twist | 300Z T/m |
| Wash resistive | 40° C. |
| Dry cleaning resistance | PER-Chloro resistant |

1. Formation of Tubular Fabric

Figure 1:
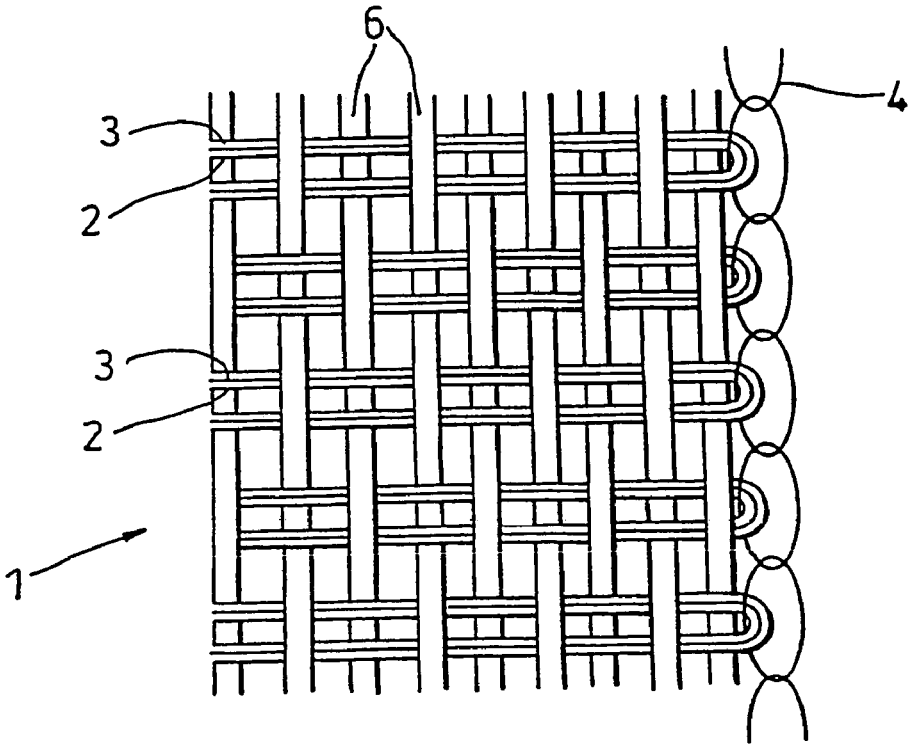
FIG. 1 is a plan view showing a fabric tape produced according to a preferred weaving method.

As shown in FIG. 1, a preferred fabric tubing 1 of the invention comprises textured polyamide 2 and Grilon™ 3 weft threads Wf and polyamide warp threads 6 woven into two tapes which are overlaid and their edges joined by edge threads 4, rising from the bottom tape to the top tape and vice versa, to form a tube 5.

Figure 4:
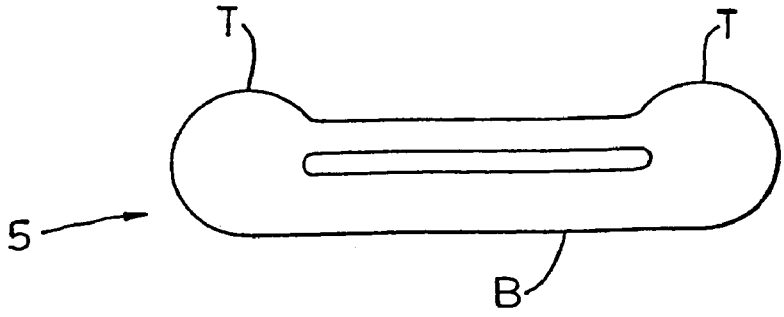
FIG. 4 is an end view of a fabric tubing according to the invention.

Each tape has its two weft threads Wf inserted by one needle N and knitted by a catch thread 7 onto a latch needle 8. Threads are preferably woven more loosely onto one side (bottom) B and the edges of the, other side (top) T to give the fabric tube a soft feel to a wearer, as shown in FIG. 4.

The tubular fabric is preferably produced using a Müller model NF 6/27 Narrow Fabric Loom fitted with a catch thread attachment (Müller NF System 3).

The loom includes twelve Heald frames. To produce each tape of fabric 2 weft needles, a catch thread attachment, 4 weft thread feeds and 4 weft thread stop motions (designed to stop the machine should the weft thread break) are employed.

Figure 2:
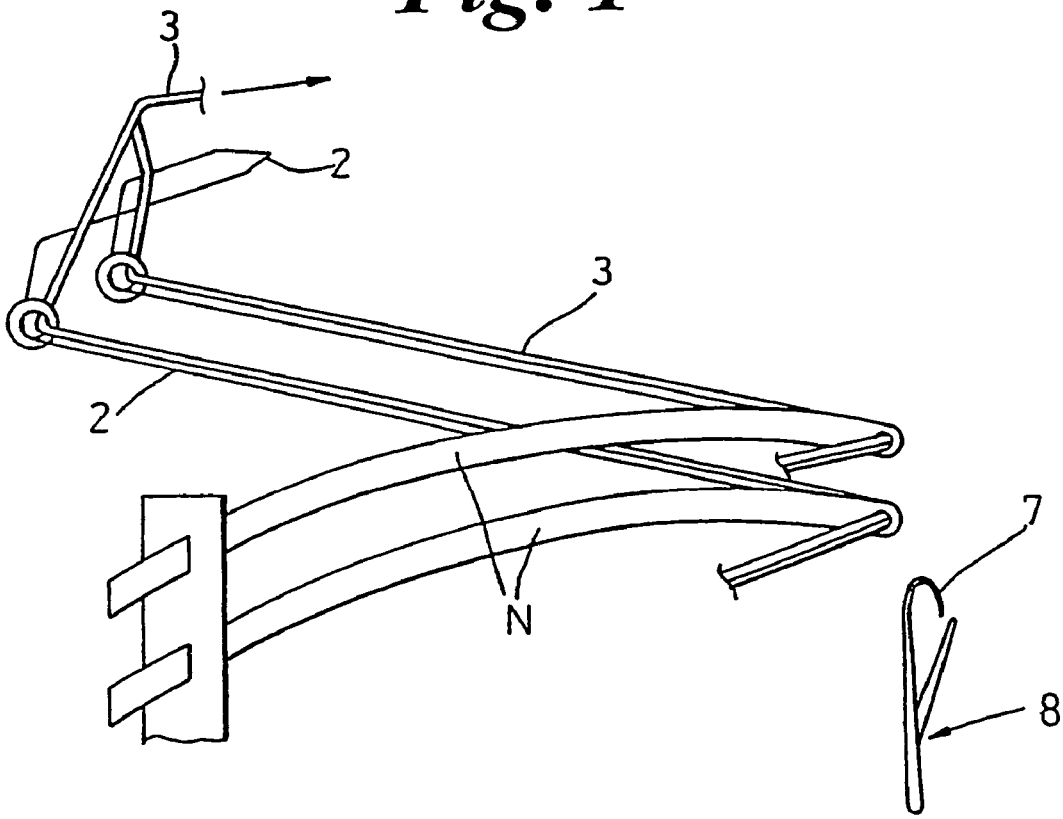
FIG. 2 shows the weft yarns, weft needles and the catch thread latch needle used in a preferred weaving method.
Figure 3:
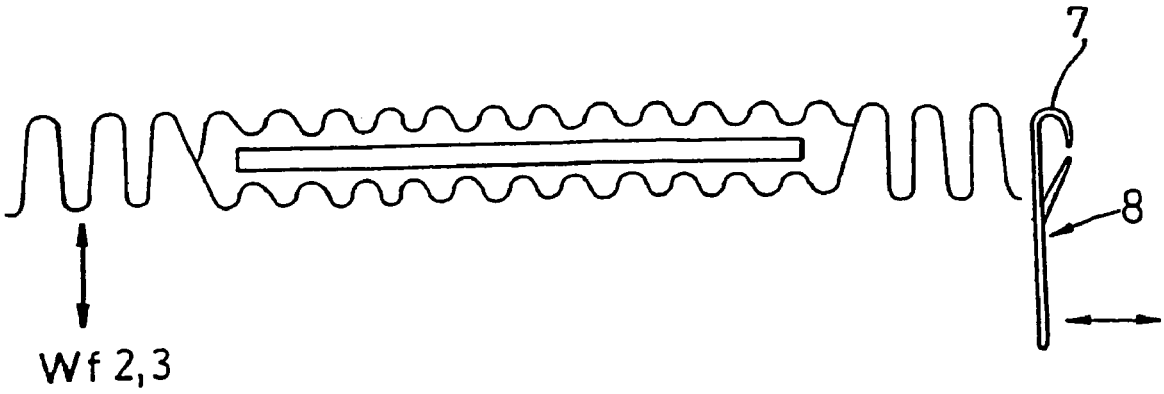
FIG. 3 shows the weft paths in the fabric.

As shown in FIG. 2 a double weft needle is used, with each needle B carrying two-weft threads 2, 3.

The loom settings are within the general knowledge of skilled person and are as set out in the relevant manufacturer's operation manual.

TABLE 1

| WARPS | Ends | YARN fold/dtex/ No. filament | COLOUR |
|---|---|---|---|
| Face | 44 | 2/78/20 Crimp Nylon | SMATT |

TABLE 1-continued

| | | | |
|---|---|---|---|
| Body | 94 | 2/78/20 Crimp Nylon | SMATT |
| Edge | 32 | 2/78/20 Crimp Nylon | SMATT |
| Binder Edge | 16 | 2/78/20 Crimp Nylon | SMATT |
| Catch thread | 1 | 1/78/20 Crimp Nylon | SMATT |
| Gut | 28 | 2/78/20 Crimp Nylon | SMATT |
| Weft | 2 | 2/110/34 Crimp Nylon | SMATT |
| Weft | 2 | 1/75/14 Grilon ™ K85 | BRT |

| | |
|---|---|
| Reed Per cm 10/8 | Per 1" 26/7 |
| Picks Per cm 13 to 19.5 | Per 1" 31-49 |
| Elongation 15% | |
| Loom Width 10.5 mm | |
| Finished Width 10 mm | |
| m/c Elongation 0% | |

Figure 5:
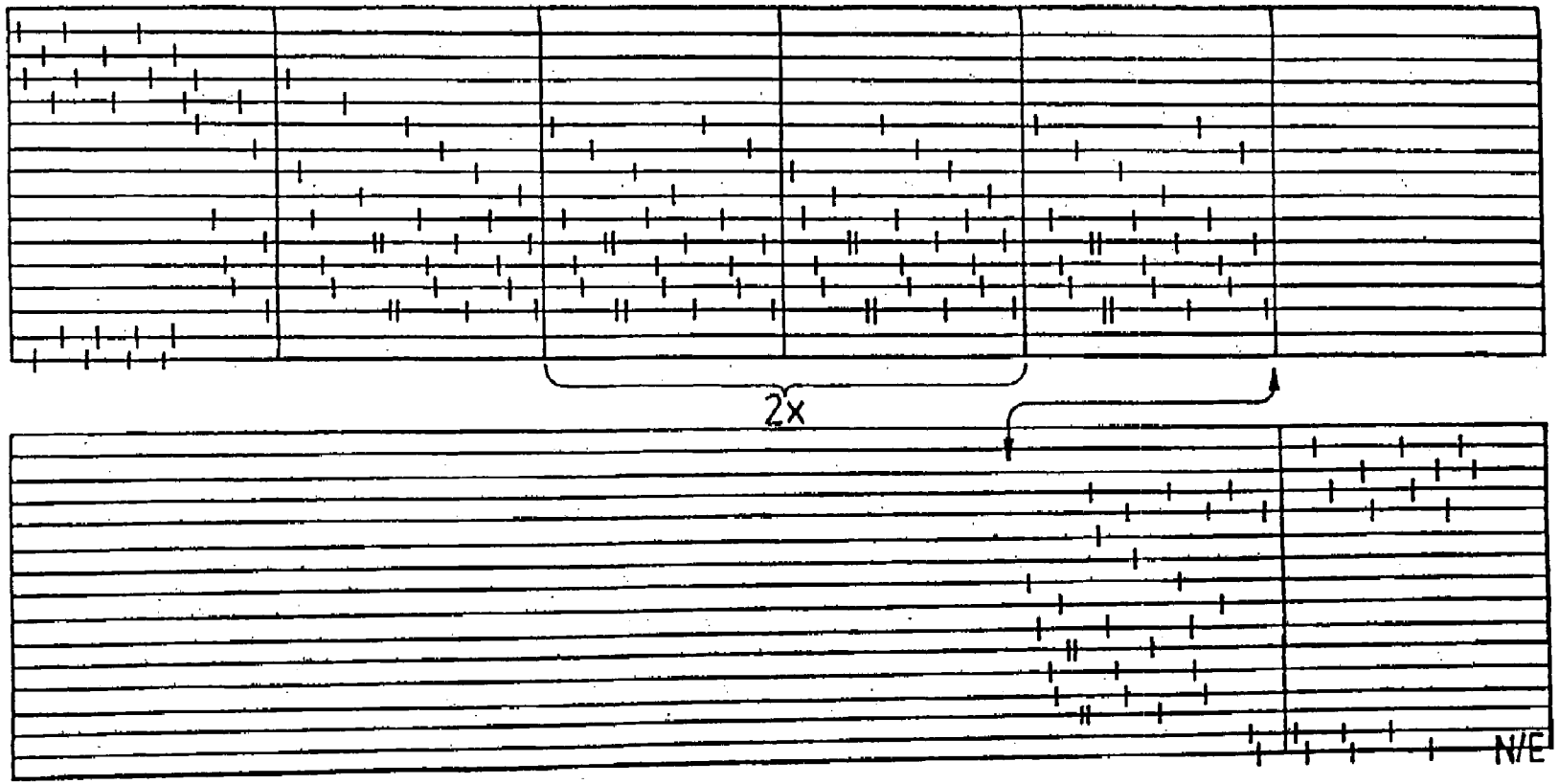
FIG. 5 shows the drawing in and front reed plan for; weaving a closed fabric tubing of the invention.

FIGS. 5 and 6 show a drawing in and reed plan and the Heald frame lifting plan to be followed to produce a preferred tubular fabric from the materials given in Table 1, by a weaving process according to the invention.

TABLE 2

| WARPS | Ends | YARN fold/dtex/ No. filament | COLOUR |
|---|---|---|---|
| Face | 58 | 2/78/24 Crimp Nylon | SMATT |
| Body | 84 | 2/78/24 Crimp Nylon | SMATT |
| Edge | 12 | 2/78/24 Crimp Nylon | SMATT |
| Gu | 32 | 2/78/24 Crimp Nylon | SMATT |
| Weft | 1 | 2/110/34 Crimp Nylon | SMATT |
| Weft | 1 | 1/75/14 Grilon ™ K85 | BRT |

| | |
|---|---|
| Reed Per cm 10/8 | Per 1" 22/18 |
| Picks Per cm 13 to 19.5 | Per 1" 34-48 |
| Elongation 15% | |
| Loom Width 20.5 mm | |
| Finished Width 19 mm | |
| m/c Elongation 0% | |

Figure 7:
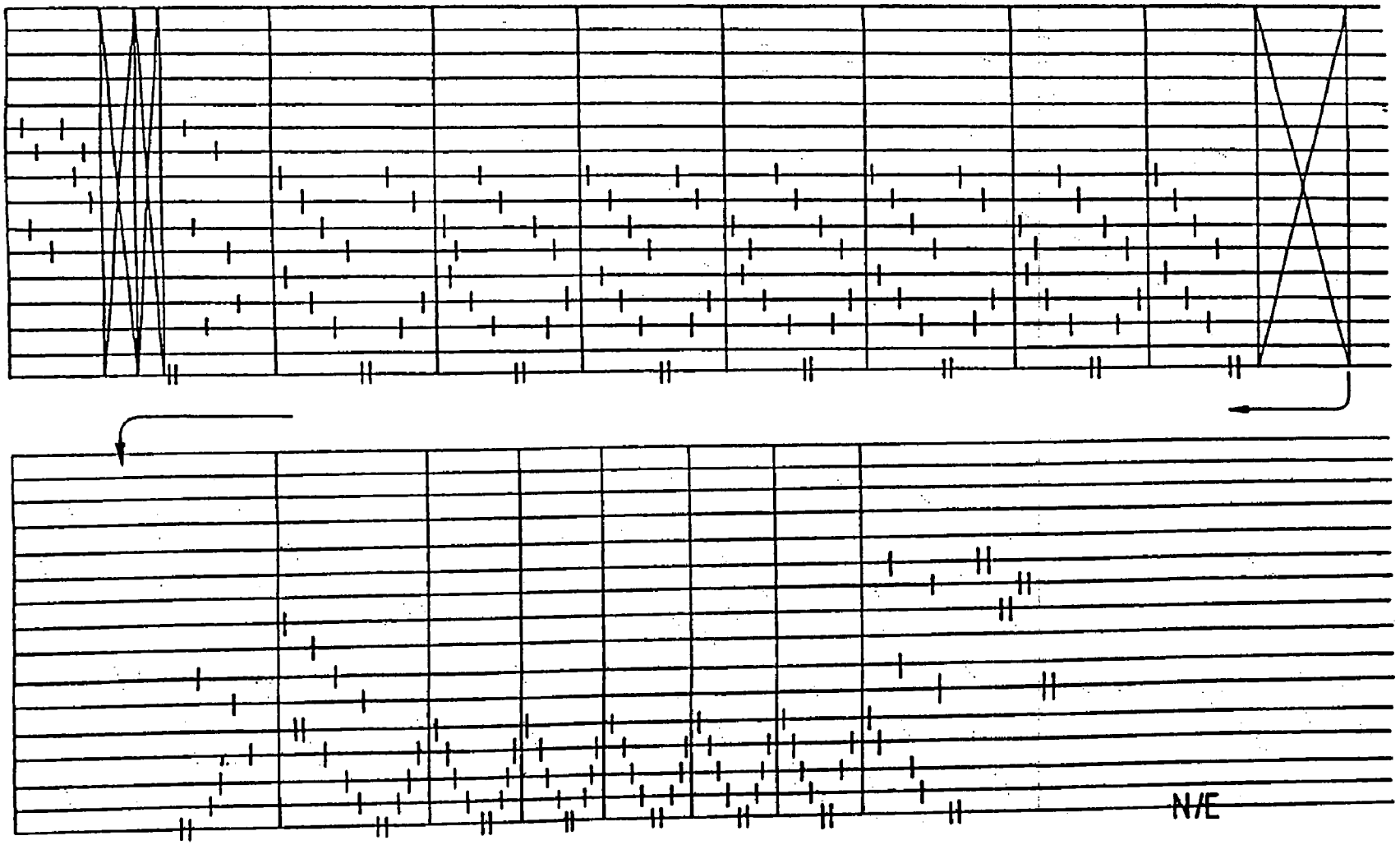
FIG. 7 shows the drawing in and front reed plan for weaving an open fabric tubing of the invention.
Figure 8:
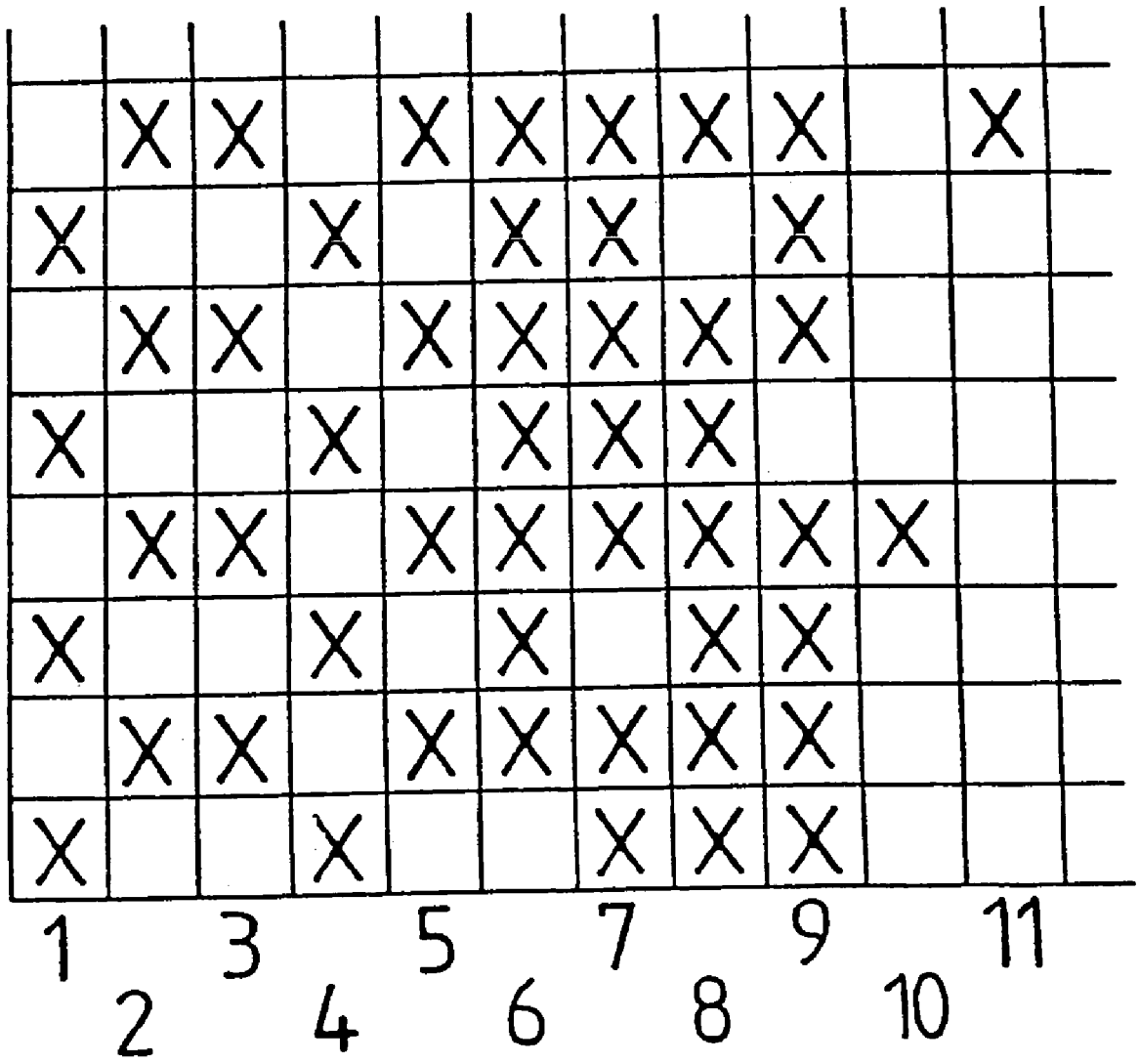
FIG. 8 shows the Heald frame lifting plan for weaving an open fabric tubing of the invention, wherein X=UP on chain, .=DOWN on chain and C=CENTRE on chain.

FIGS. 7 and 8 show a drawing in and reed plan and the Heald frame lifting plan to be followed to produce a preferred tubular fabric from the materials given in Table 2, by a weaving process according to the invention.

As mentioned previously, the tubular fabric could be produced by a knitting process employing a known fine gauge multi-bar warp or crochet knitting machine.

The preferred method of the invention produces a tubular fabric comprising a polyamide yarn and a fusible polyamide yarn, preferably Grilon™ K-85, capable of forming a barrier to penetration by a bra wire within the fabric tube. Whilst such a product may be a valuable commercial product in itself, it is preferably subjected to a further heat treatment step to provide a durable lining of fused polyamide on the interior surface of the fabric tubing. Preferably it is also subjected to heat and pressure to impart stretch into the fabric in the length direction.

2. Heat Treatment to Form Durable Tube Lining

In the preferred method the heat treatment step is carried out by a conventional polyamide dyeing process. The vat dyeing process is preferred when the fabric is to be dyed with dark colours such as red, black or blue, whereas the continuous dyeing process is preferred for whites, creams and pastel colours.

2. (i) A suitable continuous pad-steam dyeing process of the invention can be carried out with a conventional dyeing machine such as a MAGEBA™ Pad Steamer range produced by MAGEBA Textile machines GMBH & Co.

Preferably the conventional device is modified by the addition of a temperature sensing means which monitors the temperature within the dyeing machine. If the temperature falls below a predetermined level e.g. 90° C. (in excess of the melting point of the fusible Grilon™ yarn, an indicator such as a flashing light or buzzer is activated to warn an operator so that appropriate action can be taken to increase the temperature, as required.

Undyed tubular fabric of the invention is fed, at a rate of approximately 15 meters per minute, into the dye padding unit of the dyeing machine, which utilises a conventional polyamide dye (e.g. available from Hoechst, Ciba-Geigy and Sandoz). The fabric then passes into the atmospheric steamer unit where the fusible Grilon™ yarn melts. The fabric is then passed into excess dye wash off baths, size tanks and into drying cylinders (e.g. a drying unit sold by Mageba).

Throughout the process the fabric is maintained under a fixed tension by means of appropriately positioned automatic dancer arms.

The fabric residence time in the steamer unit is 2-3 minutes, preferably 2.75 minutes at a temperature of from 100-105° C. The tubular fabric is dried uniformly whilst controlling the tension of the fabric so that the dimensional stability of the fabric is optimised.

2. (ii) In the vat dyeing process a known Pegg Pulsator can be used. This machine comprises a stainless steel tank in which a dyeing solution can be heated and stirred.

Fabric to be dyed is assembled into 50 meter hanks tied loosely with string bands. The hanks are put into a dyeing solution and heated until the solution boils (which melts the Grilon™ K-85 yarn). Boiling is preferably continued for at least approximately 45 minutes. The dyed fabric hanks are then removed from the tank, rinsed and dried.

A temperature control is used to warn the operator if the temperature falls below 90° C. during the boiling step.

The tubular fabric of the invention is particularly suitable for receiving underwires and is useful in the manufacture of a range of underwired garments including bras, basques and swimming costumes. The tubular fabric of the invention can be incorporated into a garment before or after the underwire is located.

3. Compressive Shrinkage

Stretch in the length direction may be imparted to open (i.e. non-tubular) or closed (i.e. tubular) tubular fabric of the invention by compressive shrinkage. The open or closed tubular fabric is fed, under heated conditions as described above, into the nip between the roller and the sleeve of an apparatus as described in WO 01/11131. The positioning of the roller causes the path of the open or closed tubular fabric to change from convex to concave, thus compressing the fabric. The fabric is then allowed to fall away and shrinkage is retained. Grounded anti-static bars may be positioned to remove static from the system allowing fabric to fall away from the roller without the stretch-effect being reduced or destroyed by static electricity.

Closed fabric according to the invention (as defined by FIGS. 5 and 7) produced according to the above examples has a compression of from 5 to 10% and a stability of −3.0% or less.

The compression of the fabric refers to the reduction in length of the fabric when subjected to compressive shrinkage. The compression value of 5 to 10% means that for every meter of fabric treated one will obtain 90 to 95 cm of compressed fabric.

The stability value refers to the amount of shrinkage of the fabric when subjected to a normal washing process following compression. A stability value of −3.0% means that upon washing one meter of fabric shrinks to 97 cm.

The advantage of imparting stretch to the fabric in the length direction is that the stretch allows the fabric to lie flat without puckering when it is machined into garments, for example, when it is curved to receive the bra wire. By imparting stretch into the fabric by mechanical means the need to incorporate an elastomeric yarn, such as Lycra™, to impart stretch is obviated. This leads to considerable cost savings as the elastomeric yarn is relatively expensive compared to the other yarns of the fabric (other than the fusible yarn). Of course, the incorporation of some elastomeric yarn may still be desirable and such an embodiment falls within the third aspect of the invention.

4. Tubular Fabric Production from a Flat Fabric

A further preferred embodiment of the invention relates to the production of the tubular fabric of the invention from a flat strip of fabric.

The flat fabric can be formed into a tubular fabric by a variety of methods. For example, the OB1 AT116 system: produced by Sew Systems Ltd., S.U.D. Building, 22*a* Griffin Road, Clevedon, N Somerset, BS21 6HH, England provides a convenient automated method whereby flat fabric is passed through a folder system which takes the single flat strip and forms it into a tubular form which is sewn into the garment.

As the flat fabric is sewn into the garment, a bra wire is inserted as the fabric is formed into the tubular form.

The flat fabric has the same composition and general method of manufacture as the fabric described in the other embodiments.

The invention claimed is:

1. A method of making a tubular fabric with less than 0.5% elastomeric yarn comprising the steps of:

providing a support yarn and a fusible yarn;

forming said support yarn and said fusible yarn into a tubular fabric wherein said fusible yarn is arranged within said tubular fabric; and treating said tubular fabric by heating to a temperature sufficient to melt said fusible yarn within said tubular fabric and subsequently cooling said fabric to produce a barrier to penetration.

2. The method of claim 1 wherein said yarns are formed into a tubular fabric by weaving.

3. The method of claim 1 wherein said yarns are formed into a tubular fabric by knitting.

4. The method of claim 2, wherein said yarns are loosely woven on a bottom side and on at least one edge of a top side.

5. The method of claim 1 wherein said fusible yarn is comprised of a plurality of monofilaments.

6. The method of claim 1 wherein said fusible yarn is comprised of a plurality of multifilaments.

7. The method of claim 6 wherein said plurality of multifilaments is comprised of 14 filaments.

8. The method of claim 1 wherein said fusible yarn and said support yarn are composed of the same material.

9. The method of claim 1 wherein said fusible yarn is comprised of a polyamide.

10. The method of claim 1 wherein said support yarn is comprised of a polyamide.

11. The method of claim 10 wherein said support yarn is textured.

12. The method of claim 11 wherein said support yarn is a 20 filament textured polyamide yarn.

13. The method of claim 1 wherein said fusible yarn has a melting point between about 700° C. and about 900° C.

14. The method of claim 13 wherein said fusible yarn has a melting point between about 75° C. and about 90° C.

15. The method of claim 14 wherein said fusible yarn has a melting point of about 85° C.

16. The method of claim 1 wherein said tubular fabric has a melting point of at least about 100° C.

17. The method of claim 1 wherein said tubular fabric is treated by a polyamide fabric dyeing process.

18. The method of claim 17 wherein said fabric dyeing process is a batch dyeing process.

19. The method of claim 17 wherein said fabric dyeing process is a continuous dyeing process.

20. The method of claim 1 further comprising the step of treating said tabular fabric to force yarn strands located across the width of said fabric closer together to impart a stretch into the fabric in a lengthwise direction.

21. The method of claim 20 wherein said fabric is treated by applying heat and pressure.

22. The method of claim 20 wherein said fabric is treated by compressive shrinkage.

23. The method of claim 20 further comprising the step of heating said fabric to between about 80° C. and about 200° C.

24. The method of claim 1 further comprising the step of locating an underwire within a length of said tubular fabric.

25. The method of claim 24 wherein said underwire is selected flow the group consisting of metal, substantially rigid plastic and bone.

26. The method of claim 25 further comprising the step of incorporating said tubular fabric into a garment.

27. The method of claim 26 wherein said garment is selected from the group consisting of a bra, a basque and a swimming costume.

28. A garment comprising:

a wire; and a tubular fabric comprising a support yarn and a fusible yarn, wherein the fusible yarn is arranged so that when the fusible yarn melts it forms a barrier to the penetration by the wire and, wherein the tubular fabric includes less than 0.5% elastomeric yarn.

29. The garment of claim 28 wherein said support yarn and said fusible yarn are formed into a tubular fabric wherein said fusible yarn is arranged within said fusible fabric.

30. The garment of claim 29 wherein said fusible yarn has been treated by heating said fusible yarn to a temperature sufficient to melt said fusible yarn within said tubular fabric and subsequently cooling said fabric to produce a barrier to penetration.

31. The garment of claim 30 wherein said fusible yarn is comprised of a plurality of monofilaments.

32. The garment of claim 30 wherein said fusible yarn is comprised of a plurality of multifilaments.

33. The garment of claim 32 wherein said plurality of multifilaments is comprised of 14 filaments.

34. The garment of claim 33 wherein said fusible yarn and said support yarn are comprised of the same material.

35. The garment of claim 28 wherein said fusible yarn is comprised of a polyamide.

36. The garment of claim 28 wherein said support yarn is comprised of a polyamide.

37. The garment of claim 35 wherein said support yarn is textured.

38. The garment of claim 35 wherein said support yarn is a 20 filament textured polyamide yarn.

39. The garment of claim 30 wherein said fusible yarn has a melting point between about 70° C. and about 90° C.

40. The garment of claim 39 wherein said fusible yarn has a melting point between about 75° C. and about 90° C.

41. The tubular fabric of claim 40 wherein said fusible yarn has a melting point of about 85° C.

42. The garment wherein said tubular fabric has a melting point of at least about 100° C. after treatment.

43. The garment of claim 30 wherein said tubular fabric is treated by a polyamide fabric dyeing process.

44. The garment of claim 43 wherein said fabric dyeing process is a batch dyeing process.

45. The garment of claim 43 wherein said fabric dyeing process is a continuous dyeing process.

46. The garment of claim 33 wherein said tubular fabric further comprises a catch thread.

47. The garment of claim 46 wherein the tubular fabric comprises a 5-12% fusible yarn and less than 1% catch thread.

48. The garment of claim 47 wherein the tubular fabric comprises 8% fusible yarn and less than 1% catch thread.

49. The garment of claim 31 wherein the tubular fabric further comprises a catch thread.

50. The garment of claim 49 wherein the tubular fabric comprises 5-20% fusible yarn and less than 1% catch thread.

51. The garment of claim 50 wherein the tubular fabric comprises 10% fusible yarn and less than 1% catch thread.

52. The garment of claim 46 wherein said yarns are preshrunk by heat treatments or washing.

53. The garment of claim 49 wherein said yarns are preshrunk by heat treatments or washing.

54. The garment of claim 30 wherein said tubular fabric has substantially no stretch characteristics in the width direction.

55. The method of claim 1, wherein the tubular fabric has less than 0.25% elastomeric yarn.

56. The method of claim 1, wherein the tubular fabric has less than 0.1% elastomeric yarn.

57. The method of claim 1, wherein the tubular fabric has less than 0.05% elastomeric yarn.

58. The method of claim 1, wherein the tubular fabric has less than 0.01% elastomeric yarn.

59. The method of claim 1, wherein the tubular fabric has about 0% elastomeric yarn.

60. The garment of claim 30, wherein the fabric has less than 0.25% elastomeric yarn.

61. The garment of claim 30, wherein the fabric has less than 0.1% elastomeric yarn.

62. The garment of claim 30, wherein the fabric has less than 0.05% elastomeric yarn.

63. The garment of claim 30, wherein the fabric has less than 0.01% elastomeric yarn.

64. The garment of claim 30, wherein the fabric has about 0% elastomeric yarn.

65. A tubular fabric for use in encasing wires, comprising a support yarn, a fusible yarn, and less than 0.5% elastomeric yarn wherein the fusible yarn is arranged so that when the fusible yarn melts it forms a barrier to the penetration by a wire.

66. The tubular fabric of claim 65, wherein the fabric has less than 0.25% elastomeric yarn.

67. The tubular fabric of claim 65, wherein to fabric has less than 0.1% elastomeric yarn.

68. The tubular fabric of claim 65, wherein the fabric has less than 0.05% elastomeric yarn.

69. The tubular fabric of claim 65, wherein the fabric has less than 0.01% elastomeric yarn.

70. The tubular fabric of claim 65, wherein the fabric has about 0% elastomeric yarn.

* * * * *